United States Patent [19]

Wexler

[11] Patent Number: 5,037,085

[45] Date of Patent: Aug. 6, 1991

[54] DEVICE AND METHOD FOR USE IN LUMBAR-THORACIC STRETCHING AND ADJUSTMENT

[76] Inventor: Charles E. Wexler, 19225 Rosita St., Tarzana, Calif. 91356

[21] Appl. No.: 536,010

[22] Filed: Jun. 7, 1990

[51] Int. Cl.[5] ..... A61H 1/02; A63B 23/00

[52] U.S. Cl. ..... 272/93; 128/25 R; 272/127

[58] Field of Search ..... 272/93, 125, 144, 903, 272/109; 128/25 R, 69-71, 75, 78, 84 C; 108/59, 45, 96, 102, 97, 157, 43, 137; 248/127, 911, 558

[56] References Cited

U.S. PATENT DOCUMENTS

| | | | |
|---|---|---|---|
| 1,661,805 | 3/1928 | Lentaty | 248/127 |
| 2,844,429 | 7/1958 | Frey | 108/43 |
| 3,109,646 | 11/1963 | Klein | 272/903 |
| 3,470,873 | 10/1969 | Walker et al. | 128/89 R X |
| 3,554,189 | 1/1971 | Hendrickson | 128/71 |
| 3,906,648 | 9/1975 | Bard | 108/43 |
| 4,343,245 | 8/1982 | Edwards | 108/59 |
| 4,365,561 | 12/1982 | Tellier et al. | 108/96 |
| 4,549,765 | 10/1985 | Hoch | 248/558 |
| 4,608,969 | 9/1986 | Hamlin | 128/71 |
| 4,838,249 | 6/1989 | Jannotta | 128/25 R |
| 4,846,465 | 7/1989 | Iams et al. | 128/25 R |

FOREIGN PATENT DOCUMENTS

| | | | |
|---|---|---|---|
| 559867 | 4/1960 | Belgium | 108/96 |
| 812680 | 7/1951 | Fed. Rep. of Germany | 108/43 |
| 199877 | 7/1923 | United Kingdom | 108/96 |
| 269899 | 9/1927 | United Kingdom | 272/109 |

*Primary Examiner*—Richard J. Apley
*Assistant Examiner*—Jerome W. Donnelly
*Attorney, Agent, or Firm*—Edward A. Sokolski

[57] ABSTRACT

A pair of plates are interconnected by an adjustable post assembly such that the plates are in substantially parallel opposing relationship. The post assembly is constructed so that the two plates can be adjusted both pivotally and vertically relative to each other and then fixed in a desired position. The device is utilized by a person wishing stretching and/or adjustment of the lumbar and thoracic spines. Such person lies on his or her side with the uppermost knee wrapped around the post assembly and the thighs between the two plates. The upper plate is then rotated until it is directly above the upper thigh and then lowered until it presses against such thigh, using the lowermost hand, i.e. the hand closest to the table or floor on which the person is lying. With the thighs and legs fixed relative to each other, the upper torso is twisted towards the floor or table, thereby stretching and/or adjusting the lumbar and thoracic spines.

1 Claim, 2 Drawing Sheets

DEVICE AND METHOD FOR USE IN LUMBAR-THORACIC STRETCHING AND ADJUSTMENT

BACKGROUND OF THE INVENTION

1. Field of the Invention

This invention relates to orthopedic aids and more particularly to a method and device for use in facilitating stretching or adjustment of one's thoracic and/or lumbar spines.

2. Description of the Related Art

Lower back discomfort is a common ailment often attributable to misalignment of the thoracic and lumbar spines resulting in the pinching of nerves in that region. Stretching and/or adjustment to end such discomfort is generally achieved by manipulation of the body by a trained professional to correct the misalignment which end result is often accomplished by twisting the upper body to "pop" the facets of the thoracic and/or lumbar spines. While many traction devices such as described, for example in Buckner U.S. Pat. No. 4,030,489 issued June 21, 1977, are available to remove weight from the spines in the lumbar and thoracic region to thwart such misalignment, no device is known to exist, such as that of the present invention for facilitating the stretching and/or adjustment of the lower spines without outside assistance.

SUMMARY OF THE INVENTION

The device and method of the invention employ self help in stretching and/or adjusting the thoracic and lumbar spines should they become misaligned so as to cause discomfort. This end result is achieved by means of a device consisting of a pair of opposing plates which are joined together by means of an adjustable post assembly. The post assembly has mating telescoping sections to permit both rotatable and longitudinal positioning of the plates relative to each other. The post assembly also includes a tightening member to set the two plates in a desired position both vertically and rotatably relative to each other. In using the device, one lies on one's side with the lowermost thigh resting on the lower plate. The upper leg is then wrapped around the post assembly at the knee joint and the upper plate turned towards the person's head with the hand of that person's lowermost arm. The upper plate is then pressed down and stabilized against the user's uppermost thigh. With the user's thighs and legs thus fixed in position, the user rotates the upper torso towards the floor in a direction away from the upper plate independent of the lower body portions thereby stretching and/or adjusting the lumbar and thoracic spines. Often, with such adjustment, the spine facets will be felt and heard to "pop" with concurrent relief from discomfort if it exists due to this cause.

It is therefore an object of this invention to facilitate the self relief from discomfort due to misadjustment of the lumbar and thoracic spines.

It is a further object of this invention to provide a device and method for facilitating the rotation of the upper body while the thighs and legs are held in position so as to stretch and/or adjust the lumbar and thoracic spines.

Other objects of the invention will become apparent as the description proceeds in connection with the accompanying drawings.

DETAILED DESCRIPTION OF THE INVENTION

Figure 1:
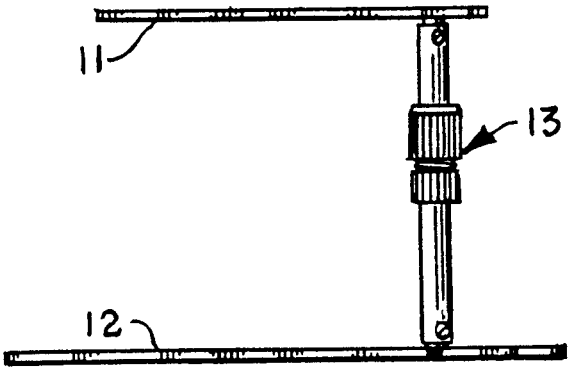
FIG. 1 is a side elevational view of a preferred embodiment of the invention.
Figure 2:
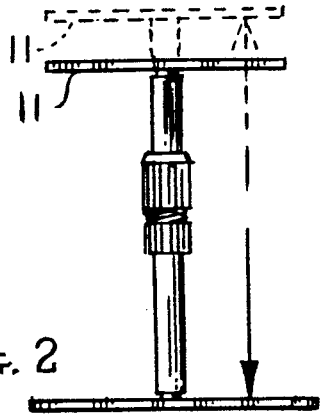
FIG. 2 is an end elevational view of the preferred embodiment illustrating the vertical adjustment thereof.
Figure 4:
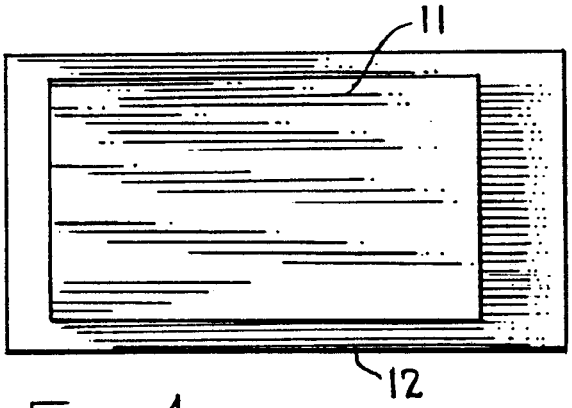
FIG. 4 is a top plan view of the preferred embodiment.
Figure 3:
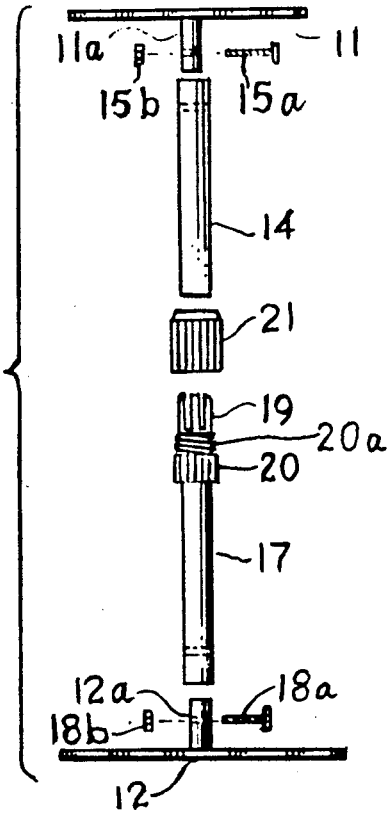
FIG. 3 is an exploded view of the preferred embodiment.
Figure 5:
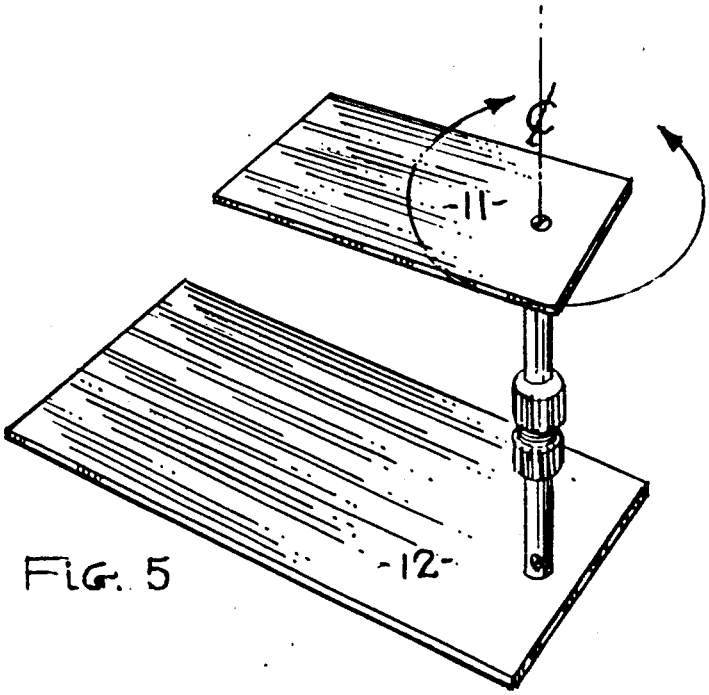
FIG. 5 is a perspective view of the preferred embodiment illustrating the horizontal adjustment thereof.

Referring now to FIGS. 1-5, a preferred embodiment of the invention is illustrated. The device comprises upper plate 11 which is joined to lower plate 12 by means of post assembly 13. Post assembly 13, as can best be seen in FIG. 3, includes a first tubular member 14 which fits over arm 11*a* of plate 11 and is fixedly attached thereto by means of screw 15*a* and nut 15*b*. The post assembly also includes a second tubular member 17 which fits over arm 12*a* of plate 12 and is fixedly attached thereto by means of screw 18*a* and nut 18*b*. Tubular members 14 and 17 are joined together for rotatable and vertical adjustment relative to each other, as shown in FIG. 5 by means of collet 19 and collars 20 and 21. Collar 20 has a threaded portion 20*a* and is fixedly attached to tubular member 17. Collet 19 is integrally formed with collar 20 and has a plurality of spring fingers which taper inwardly towards their free ends. Tubular member 14 telescopes into member 17 and thus can be adjusted vertically and rotatably relative thereto. With the tubular members adjusted relative to each other, collar 21, which threadably engages threaded portion 20*a*, can be tightened down so that it drives the spring fingers of collet 19 into clamping engagement with tubular member 14 thus maintaining the adjusted position between the two tubular members. Collar 21 can be only partially tightened down to permit adjustment between the tubular members yet at the same time maintaining such members in position relative to each other.

Figure 6:
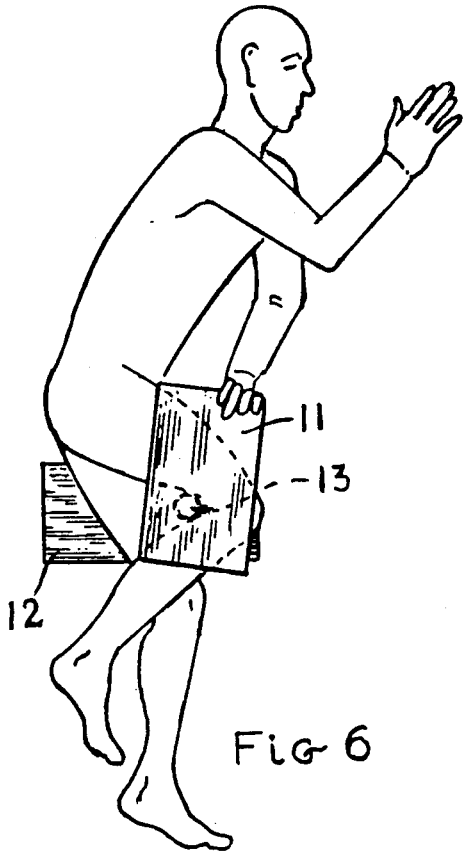
FIGS. 6 and 7 are illustrations showing the use of the device of the invention.
Figure 7:
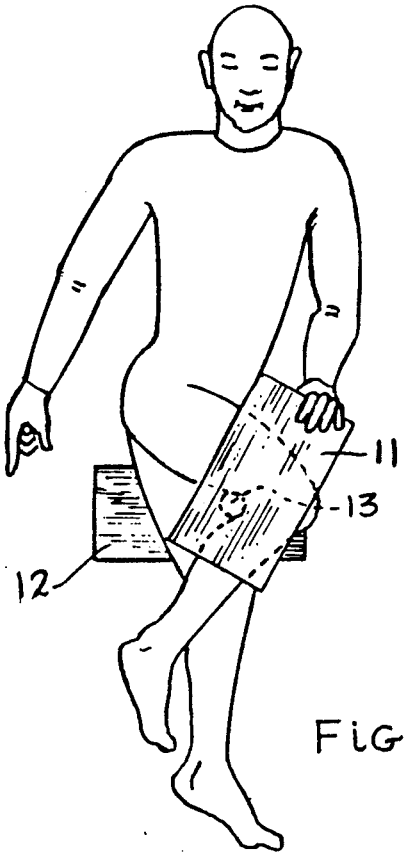

Referring now to FIGS. 6 and 7, the utilization of the device of the invention is illustrated. As shown in FIG. 6, the user lies on one side, with the lower thigh resting on the lower plate 12 and the knee joint wrapped around post assembly 13. The upper plate 11 is then positioned towards the user's head with the hand of the user's lowermost arm and pressed in a stabilizing position against the user's upper thigh so that the thighs and legs are restrained against rotation. The user then rotates the upper body while keeping the legs and thighs in their original position, as shown in FIG. 7, thereby stretching and/or adjusting the lumbar and thoracic spines and if called for "popping" the facets of the spines.

Figure 8:
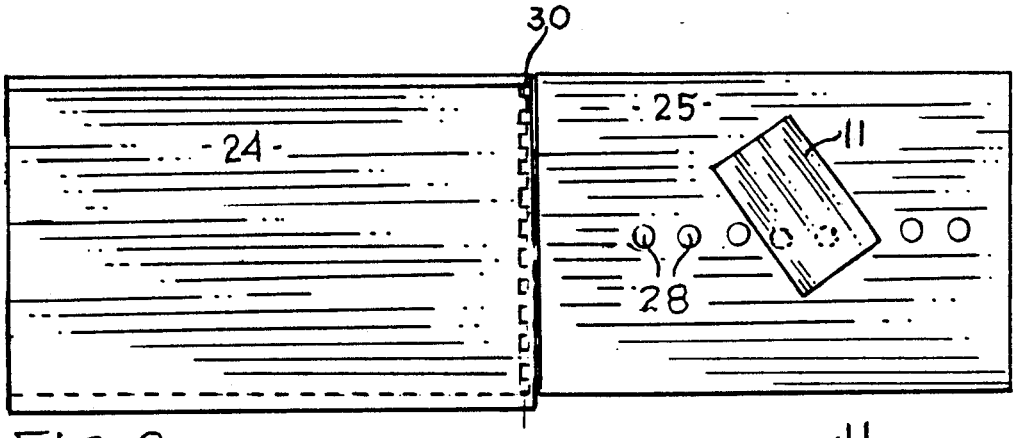
FIG. 8 is a top plan view illustrating a second embodiment of the invention employing a sliding support for facilitating upper body rotation and a large board for the lower plate.
Figure 9:
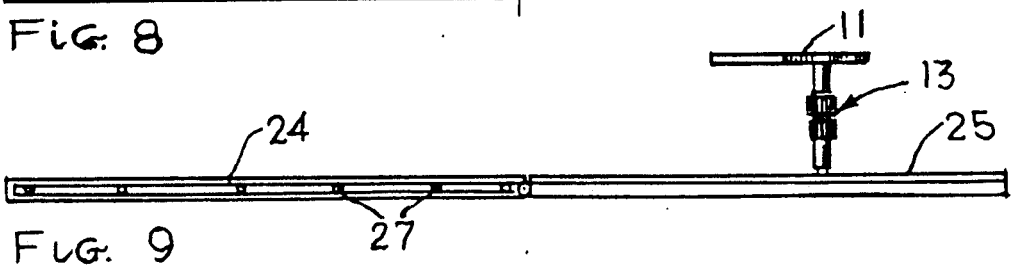
FIG. 9 is a side elevational view of the second embodiment.
Figure 10:
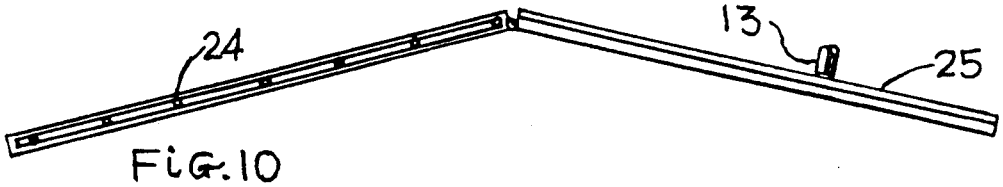
FIG. 10 is a side elevational view of the second embodiment illustrating its foldability.

Referring now to FIGS. 8–10, a second embodiment of the invention is shown. This embodiment differs from the first in the use of a base board 25 in lieu of lower plate 12 and a slidable support board 24 on which the upper body portions rest. Board 24 which is mounted on rollers 27 slides laterally relative to board 25 with rotation of the upper body, thus facilitating such rotational motion. A plurality of mounting holes 28 are provided in board 25 in which the bottom end of post assembly 13 can be selectively fitted. Boards 24 and 25 are connected together by means of hinge assembly 30 so that the two boards can be folded together for transportation. The post assembly and upper plate 11 have the same structure and operate in the same manner as described in connection with the first embodiment.

While the invention has been described and illustrated in detail, it is to be understood that this is intended by way of illustration and example only and is not to be taken by way of limitation, the scope of the invention being limited only by the terms of the following claims.

I claim:

1. A method for stretching and adjusting a person's thoracic and lumbar spinal region by using a pair of plates adjustably joined together in spaced relationship by means of a post assembly comprising the steps of:

lying on one's side with the lower thigh and leg resting on one of said plates and with the joint of the knee of the upper leg wrapped around said post assembly, pressing and rotating the other of said plates against the upper thigh and leg by means of the hand of one's arm on the same side as said lower leg, to maintain one's thighs and legs in position, and while the thighs and legs are so being maintained in position rotating one's upper body thereby stretching and/or adjusting one's lumbar and thoracic spinal region.

* * * * *